US006191749B1

(12) United States Patent
Nilsson

(10) Patent No.: US 6,191,749 B1
(45) Date of Patent: Feb. 20, 2001

(54) ARRANGEMENT COMPRISING AN ANTENNA REFLECTOR AND A TRANSCEIVER HORN COMBINED TO FORM A COMPACT ANTENNA UNIT

(75) Inventor: Mats Nilsson, Saltsjöbaden (SE)

(73) Assignee: Trulstech Innovation KB, Saltsjobaden (SE)

( * ) Notice: Under 35 U.S.C. 154(b), the term of this patent shall be extended for 0 days.

(21) Appl. No.: 09/445,438

(22) PCT Filed: Jun. 12, 1998

(86) PCT No.: PCT/SE98/01134

§ 371 Date: Dec. 13, 1999

§ 102(e) Date: Dec. 13, 1999

(87) PCT Pub. No.: WO98/57389

PCT Pub. Date: Dec. 17, 1998

(30) Foreign Application Priority Data

Jun. 13, 1997 (SE) ..... 9702268

(51) Int. Cl.[7] ..... H01Q 1/18

(52) U.S. Cl. ..... 343/765; 343/709

(58) Field of Search ..... 343/709, 757, 343/765, 766, 882; H01Q 1/12, 1/34, 3/02, 3/04, 3/06, 3/08, 1/18

(56) References Cited

U.S. PATENT DOCUMENTS 2,604,698 * 7/1952 Ewing ..... 343/765
5,359,337 10/1994 Eguchi ..... 343/765

FOREIGN PATENT DOCUMENTS 2 589 633 5/1987 (FR) .

* cited by examiner

*Primary Examiner*—Michael C. Wimer
(74) *Attorney, Agent, or Firm*—Jacobson, Price, Holman & Stern, PLLC

(57) ABSTRACT

An antenna arrangement comprising an antenna reflector (10) and a transceiver horn (11) combined to form a compact unit (10–11) includes a dynamic vibration-dampened suspension device (16), first (12) and second (15) rotation frames, and first (13) and second (15) elevation frames. The frames are rotatably mounted at the periphery of respective suspension device or frame, with the first rotation frame (12) mounted on the periphery of the suspension device and with the second rotation frame (15) mounted on the periphery of the second elevation frame (14) and functioning as an attachment for the compact antenna unit (10–11). The requisite bearing points are hereby moved to the periphery of the antenna arrangement and space is made available for accommodating the compact antenna unit (10–11) in the center of the suspension device.

1 Claim, 4 Drawing Sheets

ARRANGEMENT COMPRISING AN ANTENNA REFLECTOR AND A TRANSCEIVER HORN COMBINED TO FORM A COMPACT ANTENNA UNIT

FIELD OF INVENTION

The present invention relates to an arrangement comprising an antenna reflector and a transceiver horn combined to form a compact antenna unit. More particularly, the invention relates to an antenna arrangement that can be mounted on a movable support surface (land mobile or marine equipment) and intended particularly for two-way satellite communication equipment.

BACKGROUND OF THE INVENTION

There is often used with earlier known antenna arrangements of this kind a so-called pivot suspension in combination with advanced mechanical constructions that imply large inertia. These solutions require the application of significant forces in order to manage or handle necessary acceleration forces and result relatively often in mechanical breakdowns in the equipment.

Because of the externally acting dynamic forces to which such equipment is subjected when moving in high seas, the equipment must be mechanically strong. At the same time, there must be no play which enables the equipment to move when subjected to dynamic forces, and movement of the support relative to a predetermined geostationary satellite or an inclining satellite or other low-flying non-geostationary satellites relative to a terrestrial observer must be fully compensated for.

SUMMARY OF THE INVENTION

According to the present invention an antenna arrangement of the aforedescribed kind includes a dynamic vibration-dampened suspension device, a first rotation frame rotatably mounted on the periphery of the suspension device, a first elevation frame pivotally mounted in the first rotation frame, a second elevation frame pivotally mounted in the first elevation frame, and a second rotation frame pivotally mounted in the second elevation frame. The suspension device includes an outer part by means of which it can be mounted firmly to an underlying support, and an inner part which is fastened to said outer part through the medium of said dynamic vibration-damping means and which constitutes a support for the pivotally mounted first rotation frame. The second rotation frame is pivotally mounted on the second elevation frame and provides an attachment for the compact antenna unit.

According to this embodiment, the requisite pivot points are moved out to the perimeter of the suspension device, thereby providing space for accommodating the compact antenna unit in the centre of said device. The power unit for moving the antenna is therewith positioned at a maximum distance from the centre of rotation, whereby mechanical "play" out in the periphery of said device will be negligible, as calculated in angular measurements at the centre of the suspension device.

These and other features of the present invention will be apparent from the following claims.

BRIEF DESCRIPTION OF THE DRAWINGS

The invention will now be described in more detail with reference to the accompanying schematic drawings.

DETAILED DESCRIPTION OF PREFERRED EMBODIMENTS

Figure 1:
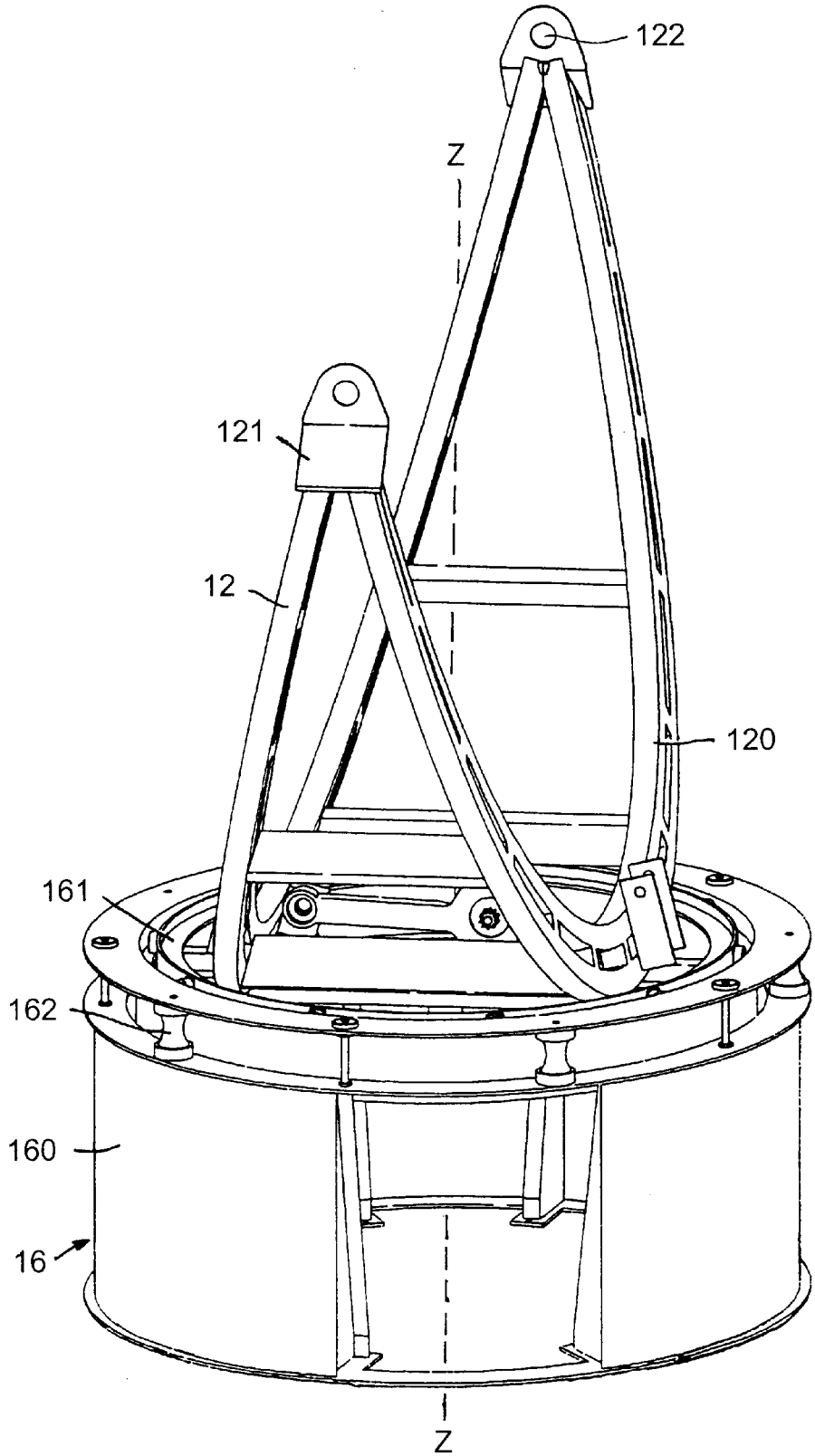
FIG. 1 illustrates a dynamic vibration-dampened suspension device and a first rotation frame.

FIG. 1 illustrates a dynamic vibration-dampened suspension device 16 that includes an outer part 160 by means of which the device can be fitted firmly to an underlying support (e.g. a ship) and an inner part 161 which is secured to said outer part through the medium of said dynamic vibration-damping means 162 and which forms a support for a rotatably mounted first rotation frame 12.

The first rotation frame 12 is arcuate in shape and has upwardly extending end-parts 121, 122 and is adapted to rotate about a first (vertical) symmetry axis z—z with a direction perpendicular to the central, lower part 120 of the rotation frame. The bottom part of the frame is attached to a ring which includes a circular cog path, adapted to be rotated by a motor, and is thereby journalled around the whole of its periphery.

Figure 2:
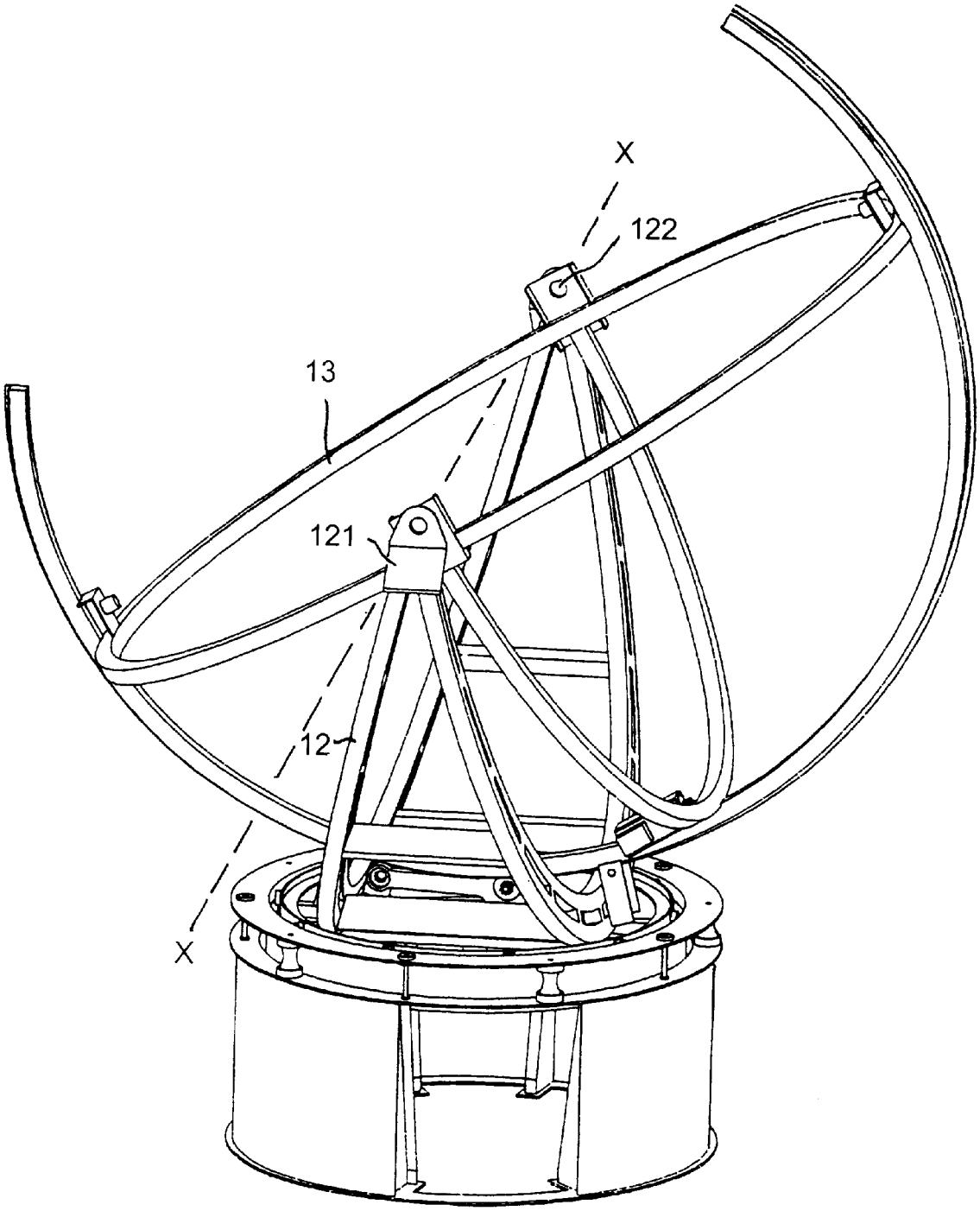
FIG. 2 illustrates in addition a first elevation frame.

FIG. 2 shows a first elevation frame 13 which is pivotally mounted in the end-parts 121, 122 of the first rotation frame 12 and which is adapted to rotate about a second symmetry axis x—x extending in parallel with a plane passing through the elevation frame 13.

Figure 3:
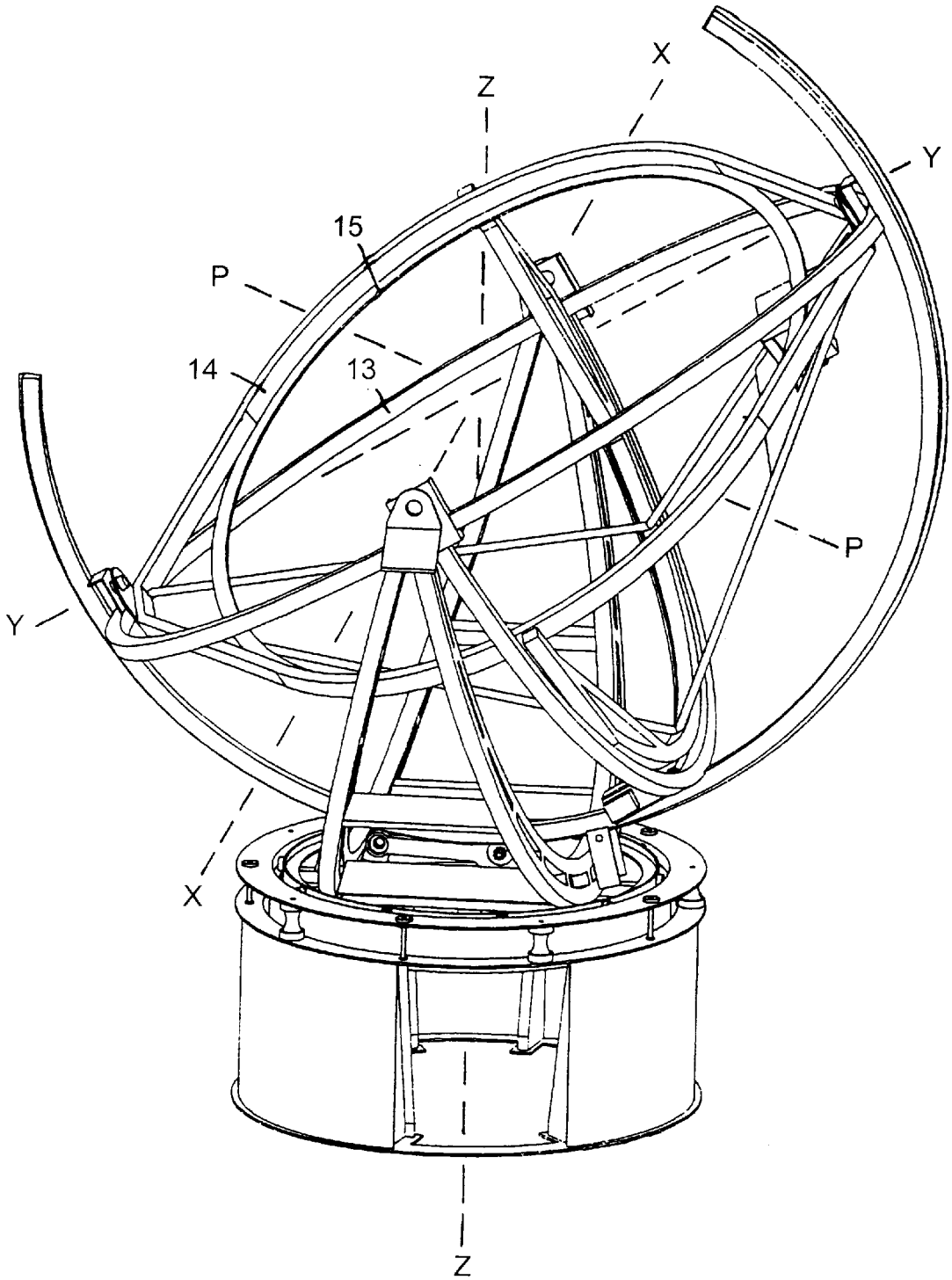
FIG. 3 illustrates in addition a second elevation frame and a second rotation frame.

FIG. 3 shows a second elevation frame 14 which is rotatably journalled in the first elevation frame 13, and a second rotation frame 15 which is rotatably journalled in the second elevation frame 14.

The second elevation frame 14 is adapted to rotate about a third symmetry axis y—y extending in parallel with the plane through the first elevation frame 13 and perpendicular to the second symmetry axis x—x.

The second rotation frame 15 forms an attachment for the compact antenna unit and is adapted to rotate about a fourth symmetry axis p—p extending in a direction perpendicular to a symmetry plane through the second elevation frame 14.

Each of the aforesaid four frames 12, 13, 14 and 15 is driven by a separate power unit located at an optimum drive distance, this distance being determined by the radius of respective frames from the rotational centre thereof.

Figure 4:
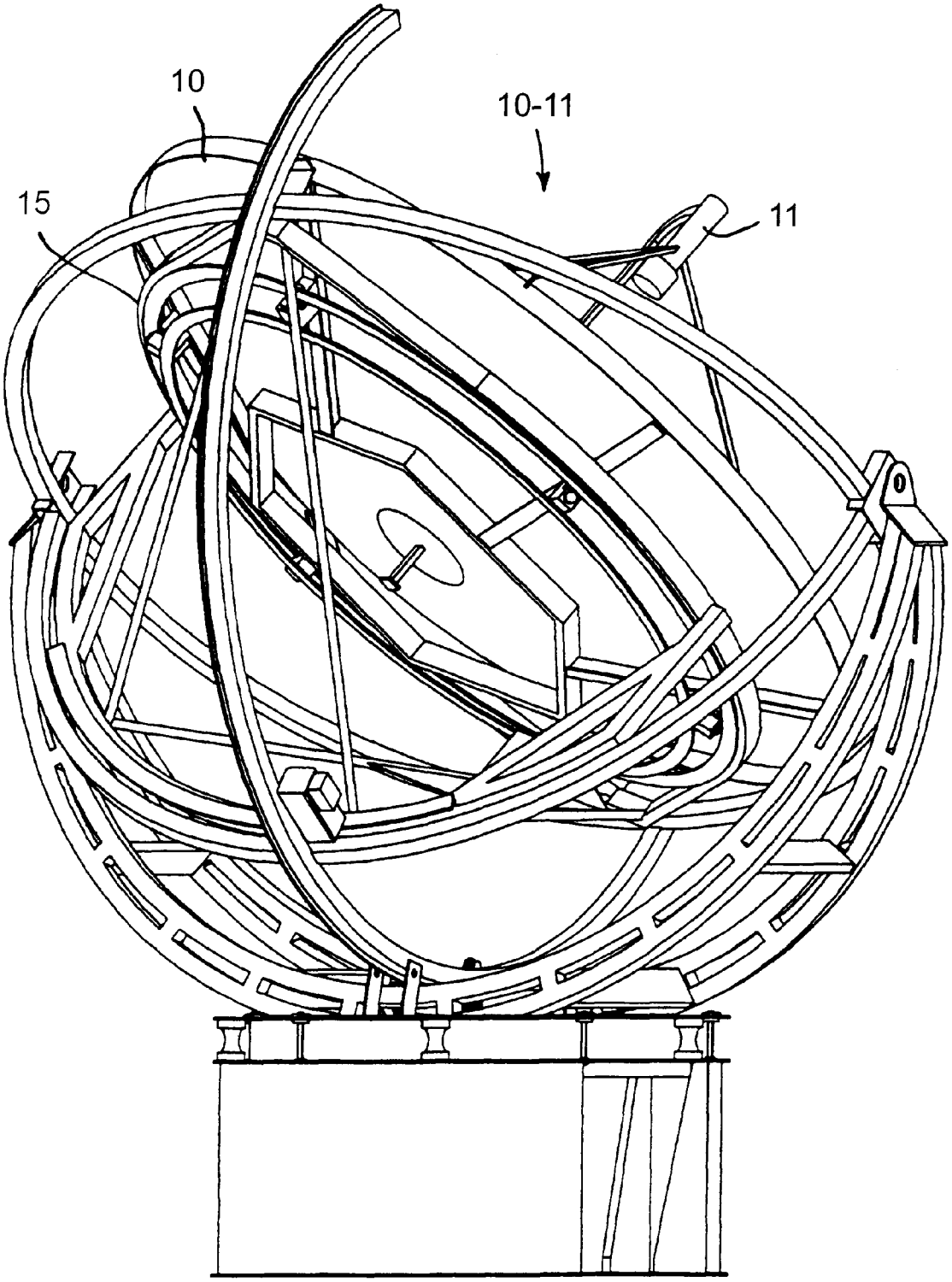
FIG. 4 illustrates in addition an antenna reflector and a transceiver horn.

As will be seen from FIG. 4, the compact antenna unit 10–11 includes antenna reflector 10 and transceiver horn 11, which are fastened to the second rotation frame 15. The mass of this unit can be balanced without providing extra counterweights in the arrangement, therewith enabling shorter reaction times to be achieved in the guiding process.

Because the frame bearing points have been moved out to the periphery, there is obtained in the centre of the suspension device sufficient space for accommodating the antenna unit, thereby enabling the antenna unit to rotate and track a moving target object without encroachment.

The arrangement is controlled by a computerised process unit that includes a tracking unit for detecting optimum bearings to an external transmitter (e.g. satellite); sensor unit for detecting forces acting externally on the arrangement (e.g. wind and relative movement of said supporting surface); power unit for desired positional settings and associated corrections; and a computer unit for total control of and adjustment to said arrangement.

What is claimed is:

1. An arrangement that includes an antenna reflector (10) and a transceiver horn (11) combined to form a compact antenna unit (10–11), characterized by a dynamic vibration-dampened suspension device (16);

a first rotation frame (12) rotatably mounted at the periphery of the suspension device (16);

a first elevation frame (13) rotatably mounted at the periphery of the first rotation frame (12);

a second elevation frame (14) rotatably mounted at the periphery of the first elevation frame (13); and a second rotation frame (15) rotatably mounted at the periphery of the second elevation frame (14);

wherein the suspension device (16) has an outer part (160) by means of which said device is fitted firmly to an underlying support surface, and an inner part (161) which is secured to said outer part (160) through the medium of a dynamic vibration-damping means (162) and which forms a support for the rotatably mounted first rotation frame (12);

wherein the first rotation frame (12) is arcuate in shape and has upwardly directed end-parts (121, 122) and is adapted for rotation about a first symmetry axis (z—z) extending in a direction perpendicular to the central part (120) of the first rotation frame (12);

wherein the first elevation frame (13) is rotatably mounted in the end-parts (121, 122) of the first rotation frame (12) and adapted for rotation about a second symmetry axis (x—x) extending in a direction parallel with a plane passing through the first elevation frame (13);

wherein the second elevation frame (14) is rotatably mounted on the first elevation frame (13) and adapted to rotate about a third symmetry axis (y—y) extending in a direction parallel with the plane passing through said first elevation frame (13) and perpendicular to said second symmetry axis (x—x); and wherein the second rotation frame (15) is rotatably mounted on the second elevation frame (14), forms an attachment for the compact antenna unit (10–11), and is adapted to rotate about a fourth symmetry axis (p—p) extending in a direction perpendicular to a symmetry plane that passes through the second elevation frame (14);

whereby requisite bearing points are moved to the periphery of the suspension device such as to provide space for accommodating the compact antenna unit (10–11) in the centre of said suspension device.

* * * * *